United States Patent [19]

Galli

[11] 4,011,954

[45] Mar. 15, 1977

[54] DISPLAY STAND

[76] Inventor: Giordano Galli, Larchenweg 15, 6078 New-Isenburg, Germany

[22] Filed: Aug. 10, 1973

[21] Appl. No.: 387,377

[30] Foreign Application Priority Data

Aug. 11, 1972 Germany ..... 2239682

[52] U.S. Cl. ..... 211/14; 108/95; 211/188

[51] Int. Cl.[2] ..... A47G 19/28

[58] Field of Search ..... 211/14, 60 R, 60 A, 211/77, 78, 74, 84; 47/34.13, 41.13; 108/94, 95, 96; 312/128, 135, 284; D6/20, 85, 188

[56] References Cited

UNITED STATES PATENTS

| | | | |
|---|---|---|---|
| 663,838 | 12/1900 | Waite | 211/60 R |
| 697,247 | 4/1902 | Harris | 211/74 |
| 1,810,258 | 6/1931 | Sperber | 211/14 X |
| 2,281,849 | 5/1942 | McCoppin | 108/94 |
| 3,169,496 | 2/1965 | Muggli et al. | 108/94 |
| 3,198,338 | 8/1965 | McCormick | 211/14 |
| D220,592 | 4/1971 | Howard et al. | D6/20 |

FOREIGN PATENTS OR APPLICATIONS

| | | | |
|---|---|---|---|
| 991,041 | 9/1951 | France | 47/41.13 |

*Primary Examiner*—James T. McCall
*Assistant Examiner*—Robert W. Gibson, Jr.
*Attorney, Agent, or Firm*—Cushman, Darby & Cushman

[57] ABSTRACT

A display stand is made up of an upper domed portion, a bottom bowl shaped portion and intermediate support discs and spacers. These discs and spacers are removable and the upper and bottom portions can then be fitted together to form an autonomous holder.

9 Claims, 2 Drawing Figures

DISPLAY STAND

This invention relates to a display stand composed of a plurality of tubular elements and plate form parts which can be assembled to form tiers which will accomodate objects to be displayed, for example chocolate eggs.

A known form of display stand has an upper portion and a bottom portion between which replaceable intermediate members can be provided. The purpose of the prior form of stand is fulfilled when it is used to carry the commodities to be displayed.

It is an object of this invention to furnish a display stand which can be used for other purposes after its function as a display stand is finished.

This object is achieved in a display stand of the kind indicated above by the present invention which prescribes the use of a bowl shaped bottom portion and a domed upper portion which, after removal of the tubular elements and the plate form parts can be assembled directly together and used for decorative purposes.

In a preferred embodiment of the invention, the bottom portion is of circular section and has at the interior thereof at least one horizontal support edge which may be continuous, this edge can be formed so as to hold a plate form part and/or the said upper portion.

Advantageously, the bottom portion has centrally thereof a vertical projection pin, or the like, which is used to receive or hold the tubular elements and/or the upper portion. Preferably this upper portion is provided with holes to receive cut flowers or the like, the upper portion may be of smaller diameter than the bottom portion and have its rim correspond to the support edge of the latter. Conveniently ribs can be provided inwards of the upper portion with their free edges, conforming with the projecting pin or the like.

The plate form parts can be circular discs with round holes which can receive displayed objects, e.g. chocolate eggs. These discs can be of different diameters.

Conveniently the assembled display stand with all its discs, may have the outline shape of an egg. The discs may be retained by seperate spacers, each of which has a central recess at one end and a corresponding pin or the like at the other.

An example of embodiment of this invention is illustrated with drawings, in which.

Figure 1:
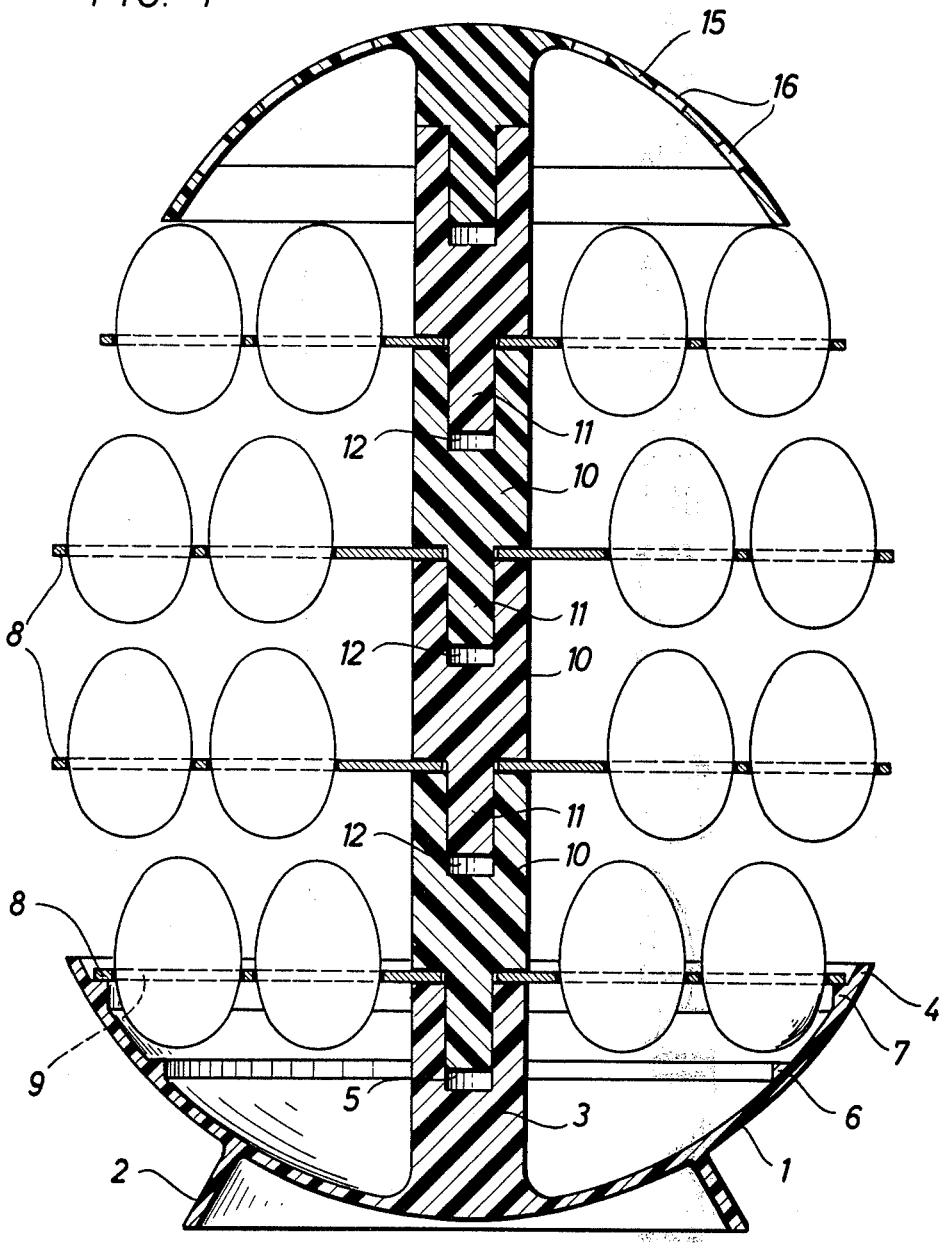
FIG. 1 is a longitudinal section through this embodiment.

As can be seen from FIG. 1, the display stand comprises a bowl shaped bottom portion 1, which is circular and has an annular support 2. This bowl shaped portion is formed somewhat as a bowl for the insertion of cut flowers.

Provided centrally of the bottom portion is a projection or pin 3 with an upper edge which is approximately level with the upper edge 4 of the bowl shaped bottom portion. The projection or pin 3 is centrally bored to provide a recess 5.

Two annular and continuous support edges 6 andd 7 are provided into bottom portion 1. These edges 6 and 7 need not be continuous and could be interrupted. The edge 7 is used as an annular support of a disc form plate 8. This latter has round holes 9 to receive chocolate eggs or the like, and in the arrangement illustrated is completely independent of any spacers or the like, as described in more detail below.

These spacers are denoted 10 and have at one end a thin spigoted extension 11 and at the other end a recess 12 with the interposition of discs 8, which may be of varying diameter, the spacers 10 enable the display stand to be built up to the required height. When use is made, as in the arrangement illustrated, of discs of different diameter, the assembled structure can have the outline shape of an egg. The curvatures of the bottom portion 1 and of the upper portion, to be described below, correspond to the obtuse end of the egg.

Figure 2:
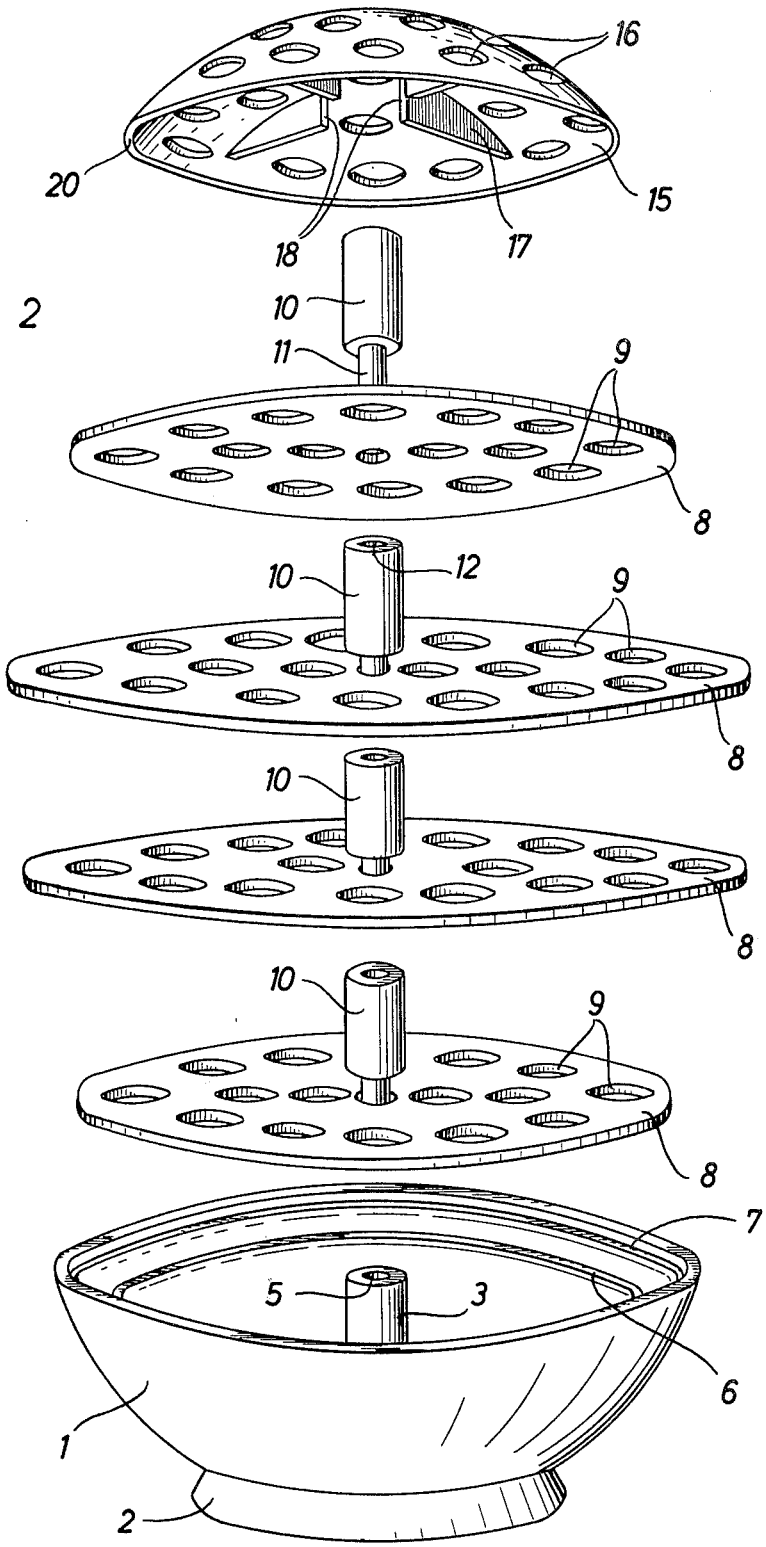
FIG. 2 is an exploded perspective illustration.

As shown in FIG. 2, the domed upper portion 15, has holes 16, which correspond to the holes in so called flower holders, that is the holes which receive the stems of cut flowers.

In a modified form of the invention, the pin-form spacer elements 10, may be rigidly connected to discs 8.

As further shown in FIG. 2, the domed upper portion 15, may be provided with projecting ribs 17, which are so devised and arranged that their inner edges 18, are replaced to define an area in which a spacer 10, can be accomodated.

When the display stand is to be used as a flower holder, all the discs 8, and spacers 10, are removed and the domed upper portion 15, is placed directly on the bowl shaped bottom portion 1, with the rim 20, of the upper portion 15, resting directly on the support edge 6.

I claim:

1. A display stand comprising an upper domed portion, said portion having a plurality of holes therein for receiving objects to be inserted therein, a bottom portion in the shape of a bowl, a plurality of article supporting plates and spacer elements, removably mounted in stacked condition between said bottom portion and said upper portion, and means formed on said upper and bottom portions for providing for an interfitting engagement therebetween so that said supporting plates and spacers can be removed and said upper domed portion can be disposed in direct interfitting engagement with said lower portion to form a holder structure.

2. A display stand according to claim 1, in which the bowl and the upper portion are provided internally and centrally in each case with an upstanding spigot, and the spigots of these two portions are formed for detachable engagement with one another.

3. A display stand according to claim 2, in which the spacer elements are formed for engagement with each other and with the spigots of said upper and bottom portions.

4. A display stand according to claim 3, in which the spacer elements are of cylindrical shape and provided at one end with a pin and at the other end with a bore for receiving the pin on an adjacent spacer element, and the spigot of the bottom portion is provided with a bore to receive the pin of a spacer element and the spigot of the upper portion with a pin for engagement in the bore of a spacer element or in the bore in the spigot of the bottom portion.

5. A display stand according to claim 1, in which the said supporting plates are circular discs with holes for receiving objects to be displayed.

6. A display stand according to claim 5, in which the discs are of different diameters.

7. A display stand according to claim 6, in which the assembled stand with all its discs, has the outline shape of an egg.

8. A display stand as recited in claim 1 wherein said bottom is circular in section, and wherein said means formed on said bottom portion for providing for an interfitting engagement with said upper portion includes at least one circumferentially disposed support rib formed on the inner surface of said bottom portion.

9. A display stand as recited in claim 8 wherein said upper portion is smaller in diameter than said bottom portion, and wherein said means formed on said upper portion for providing for an interfitting engagement with said bottom portion includes a free edge depending from said upper portion adapted to cooperate with said rib of said bottom portion.

* * * * *